United States Patent [19]

Peterson

[11] 4,446,621

[45] May 8, 1984

[54] FABRIC REPAIRING TOOL WITH CYLINDRICAL SHEET METAL CUTTER

[75] Inventor: Wesley R. Peterson, Bound Brook, N.J.

[73] Assignee: The Singer Company, Stamford, Conn.

[21] Appl. No.: 437,716

[22] Filed: Oct. 29, 1982

[51] Int. Cl.[3] ..... B26B 13/26

[52] U.S. Cl. ..... 30/241; 30/131; 30/358; 83/689

[58] Field of Search ..... 156/98; 30/128, 130, 30/131, 241, 358; 83/689

[56] References Cited

U.S. PATENT DOCUMENTS

| | | | |
|---|---|---|---|
| 138,357 | 4/1873 | Allen . | |
| 267,751 | 11/1882 | Kennedy | 83/689 |
| 1,322,876 | 11/1919 | Cameron | 83/689 |
| 2,374,400 | 4/1945 | Westervelt | 30/358 |
| 3,266,346 | 8/1966 | Voissem | 30/128 X |
| 3,271,217 | 9/1966 | Mapson | 156/98 |
| 3,558,385 | 1/1971 | Ronning | 30/130 X |
| 4,047,300 | 9/1977 | Sweeney | 30/358 |
| 4,111,207 | 9/1978 | Seiler | 30/241 X |
| 4,210,146 | 7/1980 | Banko | 30/241 X |
| 4,358,335 | 11/1982 | Reinert | 156/98 |

*Primary Examiner*—Jimmy C. Peters

*Attorney, Agent, or Firm*—William V. Ebs; Robert E. Smith; Edward L. Bell

[57] ABSTRACT

A fabric repairing tool is provided with a cylindrical sheet metal cutter having a helically extending sharp cutting edge. The cutter is affixed to an arbor which moves the cutter into a die mounted within a stationary sleeve wherein the arbor is slidably supported to cut out a piece from fabric held in the path of the cutter.

10 Claims, 6 Drawing Figures

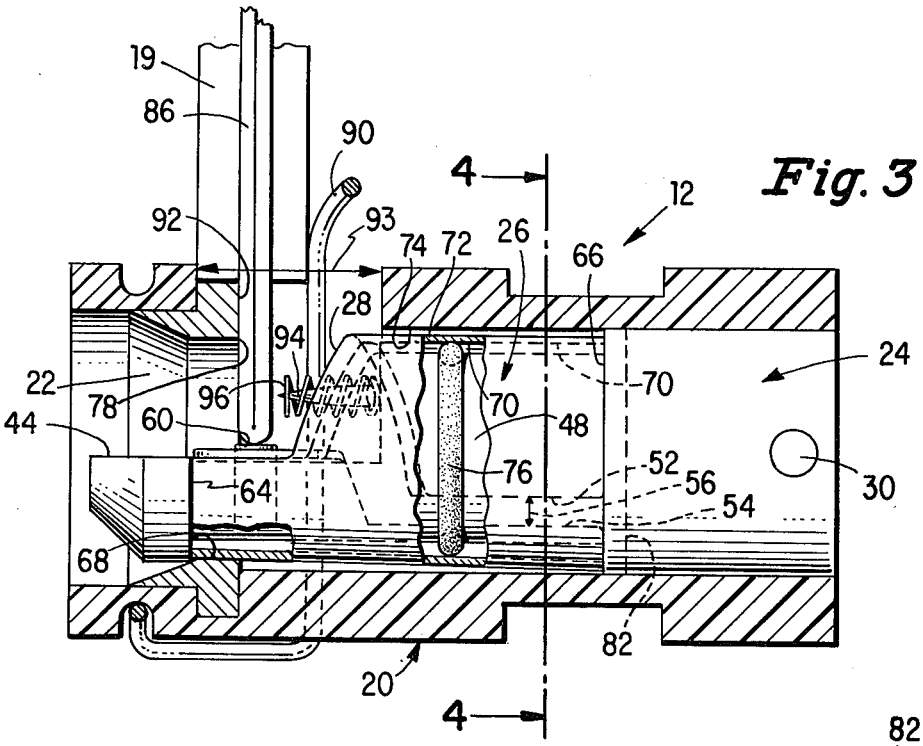
Fig. 3.
Fig. 4.
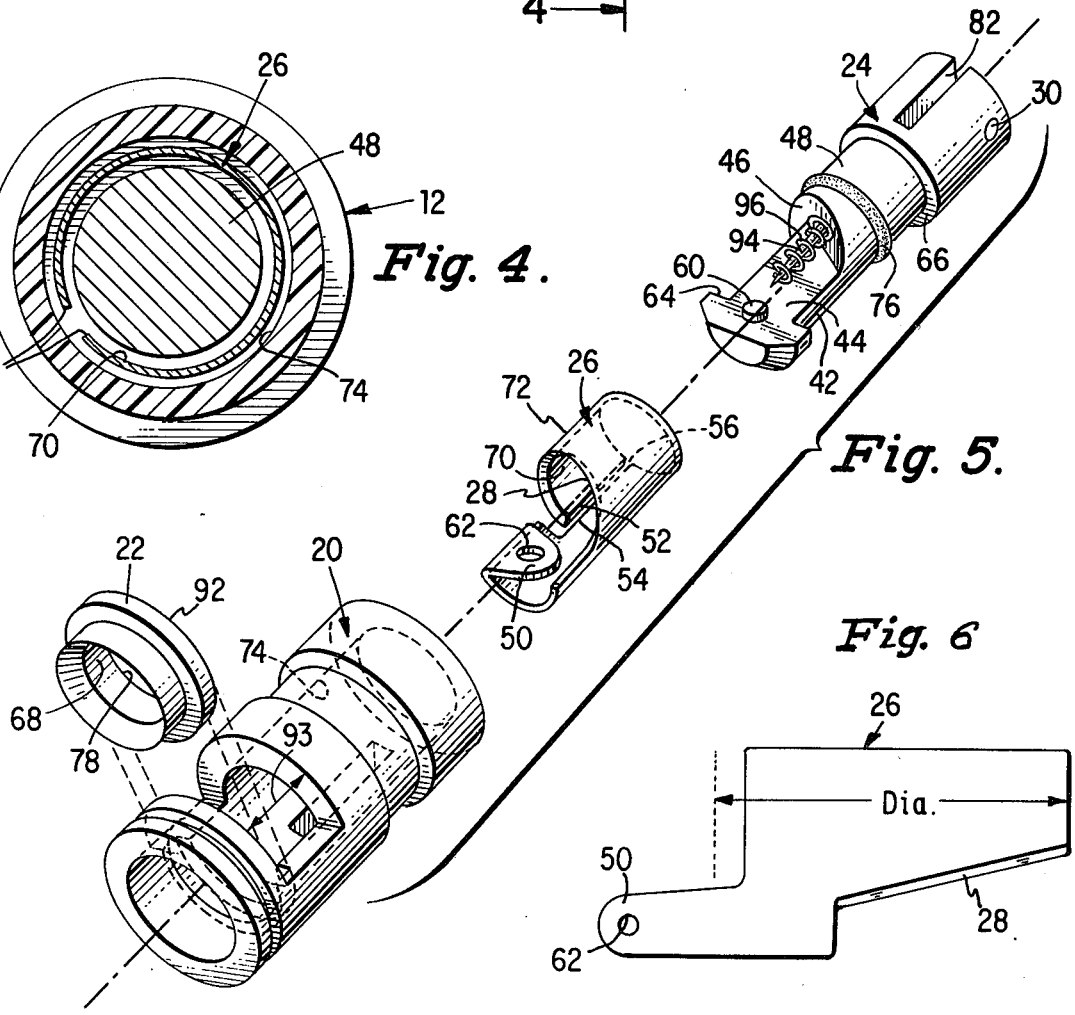
Fig. 5.
Fig. 6

FABRIC REPAIRING TOOL WITH CYLINDRICAL SHEET METAL CUTTER

DESCRIPTION

BACKGROUND OF THE INVENTION

1. Field of the Invention

The invention is directed to a fabric repairing tool of the kind disclosed in the copending patent application of Laude et al for Fabric Shearing and Heating Tool, Ser. No. 372,496, filed Apr. 28, 1982 now U.S. Pat. No. 4,424,094 issued Jan. 3, 1984. More particularly, the invention is directed to an improved cutter assembly for use in such a tool.

2. Description of the Prior Art

The tool of the said patent application (Ser. No. 372,496) is provided with a cutter assembly which is used to cut a hole in fabric at a damaged site of sufficient size to include all of a damaged area, and to cut out a patch for the hole from an unnoticeable part of the damaged fabric. Such cutter assembly includes a metal sleeve which serves as a die, and a cylindrical solid metal cutter which can be moved axially in the sleeve to cut through fabric held by a clamp in a slot in the sleeve. Extensive machining operations on both the sleeve and cutter is required and the production of such cutter assembly is therefor both time consuming and costly.

It is a prime object of the present invention to provide a fabric repairing tool with an improved cutter assembly which can be manufactured with little machining and inexpensive components.

It is another object of the invention to enable the use of a cylindrically formed sheet metal cutter in a fabric repairing tool of the described type.

Other objects and advantages of the invention will become apparent during a reading of the specification taken in connection with the accompanying drawings.

SUMMARY OF THE INVENTION

In accordance with the invention, a fabric repairing tool is provided with a cutter assembly comprising a fixed plastic sleeve, an arbor which is slidable in the plastic sleeve, a compressible cylindrically formed resilient sheet metal cutter which is affixed to the arbor and has a sharp helically extending cutting edge, and a die in the form of a metal ring which is affixed within the plastic sheet in a position of alignment with the cutter. The cutter is advanced by the arbor in the plastic sleeve and is thereby caused to cut fabric which is held by a clamp against the die within a slot in the plastic sleeve. The arbor is provided with a fabric piercing needle and with a spring which ejects cut fabric from the needle propelling it through the die.

DESCRIPTION OF THE DRAWINGS

FIG. 3 is an enlarged vertical sectional view of the cutter assembly;

FIG. 4 is a cross sectional view taken on the plane of the line 4—4 of FIG. 3;

FIG. 5 is a disassembled perspective view of the cutter assembly; and

FIG. 6 is a plan view of a sheet metal blank used in forming a sharp edged cutter for the cutter assembly.

DESCRIPTION OF THE PREFERRED EMBODIMENT

Figure 1:
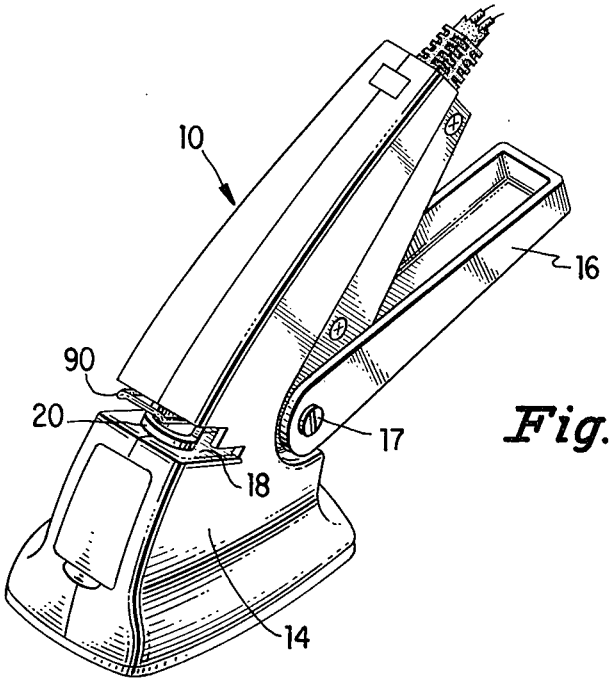
FIG. 1 is a perspective view of a fabric repairing tool provided with the cutter assembly of the invention.

Referring to the drawings, reference character 10 designates a fabric repairing tool including the cutter assembly 12 of the invention. The tool which is of the kind disclosed in the copending patent application of Laude et al, Ser. No. 372,496, includes a plastic housing 14, and a lever 16 mounted therein for pivotal movement on a pin 17. The lever 16 is used to effect a fabric cutting operation. Housing 14 is formed with a slot 18 wherein a fabric clamp 19, as described in the said copending patent application, can be disposed to suitably locate a fabric portion in the tool for a cutting operation.

Cutter assembly 12 includes a molded plastic sleeve 20 which is affixed in the housing 14, a sharp edged metal ring 22 which is affixed in the plastic sleeve to serve as a die, an arbor 24 which is slidable in the plastic sleeve, and a compressible sheet steel cylindrically formed cutter 26 which is fastened to the arbor and has a helically extending cutting edge 28.

Arbor 24 is pin connected at 30 to a shaft 32 which passes through a housing wall 34 and extends rearwardly in the housing to a terminal flange 36. A spring 38 surrounding the shaft 32 biases the shaft and arbor 24 rearwardly in the housing to a position defined by engagement of the arbor with wall 34 at 40. The arbor includes a semicylindrical forward end portion 42 which defines a planar transversely extending surface 44 in front of an oblique upstanding face 46. A cylindrical surface 48 extends rearwardly on the cutter from face 46.

Figure 2:
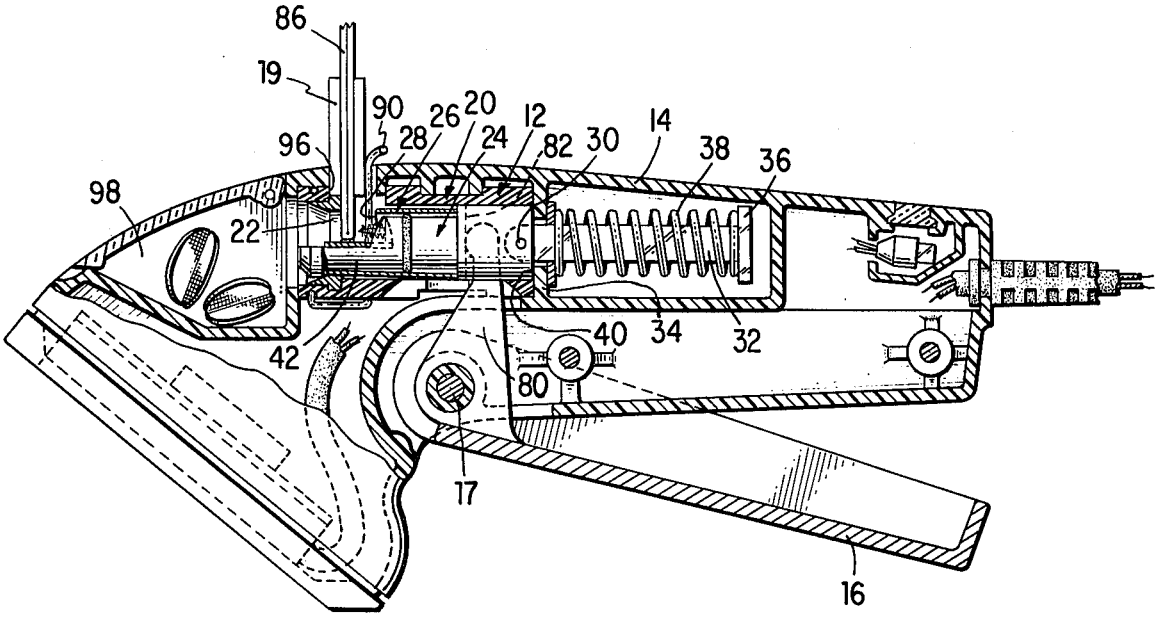
FIG. 2 is a vertical sectional view of the tool of FIG. 1.

Cutter 26 is a cylindrical member with a transversely extending tongue 50 and with longitudinally extending opposite edges 52 and 54 which are separated by a gap 56. The cutter is formed from a sheet metal blank having an oblique sharpened edge 28 and spring like resiliency (see FIG. 6). The cutter is attached to arbor portion 42 on planar surface 44 as with a pin 60 in a hole 62 in the tongue, and extends about cylindrical surface 48 on the arbor between confining rims 64 and 66. In the unactuated condition of the tool (FIGS. 2 and 3), cutter 26 is engaged just behind rim 64 by the inside surface 68 of ring 22. The cutter has a somewhat reduced diameter at such location as enforced by ring surface 68, and extends therefrom to a relaxed diameter about arbor surface 48. The inside surface 70 and outside surface 72 of the cutter are spaced from arbor surface 48 and inside surface 74 of sleeve 20 as shown. A resilient O-ring 76 located within a groove in the arbor engages the inside surface of the cutter. Ring 22 has a sharp cutting edge 78. When the tool 10 is operated by squeezing lever 16, an integral arm 80 of the lever extending into a slot 82 in arbor 24 is caused to forcibly engage and move the arbor to the left within sleeve 20 against the bias of spring 38. The cutter is moved with the arbor and is thereby rendered effective to cut fabric held within the tool by clamp 19 of the kind disclosed in the patent application of Laude et al, Ser. No. 372,496, mentioned hereinbefore. FIGS. 2 and 3 show fabric 86 folded in clamp 19 and the clamp situated in housing slot 18, the clamp being biased by a spring 90 into a position where one side of the folded fabric is against the end surface 92 of ring 22 within a slot 93 in the sleeve 20 and the fabric extends into the path of the cutter.

As the arbor 24 is advanced by the squeezing of lever 16, cutter 26 is compressed by ring surface 68, the compression being accommodated by a narrowing of gap 56. Cutter edge 28, extending helically around the arbor, moves into the ring and as the folded fabric is encountered by cutter edge 28 moving around sharp edge 78 on ring 22, a circular piece is cut from the fabric. The inherent resiliency of the cutter and O-ring 76 assure a tight and stabilized engagement of the cutter with the inside surface 68 of the ring. A cutting operation is complete once the helically extending edge 28 of the cutter has completely passed beyond ring edge 78. Lever 16 may then be released to permit spring 38 to return the arbor 24 and cutter 26 to their initial positions.

A needle 94 is affixed to arbor 24 so as to project from surface 46 in a direction parallel to the longitudinal axis of the arbor. The needle is surrounded by a helical spring 96 having one end affixed to the arbor. During a cutting operation, the needle is caused to pierce the fabric being cut and the spring is compressed. When the fabric has been cut through, the spring expells the cut piece of fabric from the needle and it is ejected through the ring into a cup-like formation 98 within tool housing 14.

It is to be understood that the present disclosure relates to a preferred embodiment of the invention which is for purposes of illustration only and is not to be construed as a limitation of the invention. Numerous alterations and modifications will suggest themselves to those skilled in the art, and all such modifications which do not depart from the spirit and scope of the invention are intended to be included within the scope of the appended claims.

I claim:

1. A fabric repairing tool including a stationary sleeve, an arbor slidable in said sleeve, a sheet metal cutter which is movable with the arbor and has a sharp helically extending edge thereon, and a sharp edged ring which is in alignment with the cutter and against which fabric is cut by sliding the arbor in a direction causing said helical cutting edge to enter the ring and in so doing to move around the sharp edge of the ring.

2. A fabric repairing tool according to claim 1 wherein the ring is affixed in the sleeve.

3. A fabric repairing tool according to claim 2 wherein the sleeve is plastic.

4. A fabric repairing tool according to claim 1 wherein the cutter is of a resilient material and is compressible diametrically by the ring.

5. A fabric repairing tool according to claim 4 including a compressible resilient O-ring between the arbor and cutter.

6. A fabric repairing tool according to claim 4 wherein the cutter includes longitudinally extending opposing edges separated by a gap which is narrowed by compression of the ring.

7. A fabric repairing tool according to claim 1 wherein the arbor includes a semicylindrical forward end portion, and the cutter includes a transversely extending portion which is fastened to the forward end portion of the arbor.

8. A fabric repairing tool according to claim 7 wherein the cutter includes a cylindrical portion on which the helically extending cutting edge is formed, said cylindrical portion including spaced apart longitudinally extending opposing edges.

9. A fabric repairing tool according to claim 8 wherein the cutter is of a resilient material and said cylindrical portion is compressible by the ring.

10. A fabric repairing tool according to claim 1 including a fabric piercing needle on the arbor and a spring about the needle for expelling a cut fabric piece from the needle.

* * * * *